US006466154B1

(12) United States Patent
Kim et al.

(10) Patent No.: US 6,466,154 B1
(45) Date of Patent: Oct. 15, 2002

(54) REMOTE CONTROLLER INTEGRATED WITH WIRELESS MOUSE

(75) Inventors: Byoung-taek Kim, Suwon (KR); Chung-sik Bang, Suwon (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/187,414

(22) Filed: Nov. 6, 1998

(30) Foreign Application Priority Data

Dec. 1, 1997 (KR) ..... 97-65046

(51) Int. Cl.[7] ..... G08C 19/12

(52) U.S. Cl. ..... 341/176; 341/173; 345/158; 345/163; 348/552

(58) Field of Search ..... 341/20, 173, 176, 341/26; 345/163, 167, 156, 158, 172; 348/734, 564, 601, 552

(56) References Cited

U.S. PATENT DOCUMENTS 4,754,268 A * 6/1988 Mori ..... 345/158
4,855,746 A * 8/1989 Stacy ..... 341/176
5,280,276 A * 1/1994 Kwok ..... 345/167
5,457,479 A * 10/1995 Cheng ..... 345/163
5,457,480 A * 10/1995 White ..... 345/163
5,563,631 A * 10/1996 Masunaga ..... 345/169
5,583,541 A * 12/1996 Solhjell ..... 345/163
5,724,106 A * 3/1998 Autry ..... 341/176
5,767,841 A * 6/1998 Hartman ..... 345/167
5,798,715 A * 8/1998 Saperstone ..... 341/22
5,831,555 A * 11/1998 Yu ..... 341/26
5,854,621 A * 12/1998 Junod ..... 345/158
5,923,757 A * 7/1999 Hocker ..... 380/21
5,949,401 A * 9/1999 Kazarian ..... 345/156
5,959,557 A * 9/1999 Lim ..... 341/176
5,973,757 A * 10/1999 Aubuchon et al. ..... 341/176
5,990,868 A * 11/1999 Frederick ..... 345/158
6,040,820 A * 3/2000 Choi ..... 345/156
6,078,789 A * 6/2000 Bodenmann ..... 455/66
6,184,869 B1 * 2/2001 Harding ..... 345/163
6,208,384 B1 * 3/2001 Schultheiss ..... 345/719
6,313,851 B1 * 11/2001 Matthews et al. ..... 345/717

FOREIGN PATENT DOCUMENTS

KR 94-24726 11/1994 ..... G11B/15/02

* cited by examiner

*Primary Examiner*—Michael Horabik
*Assistant Examiner*—Albert K. Wong
(74) *Attorney, Agent, or Firm*—Sughrue Mion, PLLC

(57) ABSTRACT

An integrated remote controller/wireless mouse includes first and second buttons installed on the upper surface of a body for operating first and second apparatuses, respectively, a signal generator for generating optical signals for controlling functions of the apparatuses in accordance with the operation of the buttons, and a track ball, protruding from the bottom surface of the body, to allow free rolling movement for operating the second apparatus.

2 Claims, 7 Drawing Sheets

REMOTE CONTROLLER INTEGRATED WITH WIRELESS MOUSE

BACKGROUND OF THE INVENTION

1. Field of the Invention

The present invention relates to a remote controller used for controlling functions of a television or a stereo, and more particularly, to a remote controller integrated with a wireless mouse used as a pointing device of a computer.

2. Description of the Related Art

A wireless mouse 10, as shown in FIG. 1, transmits signals through a line 12 connecting a mouse body 11 to a computer case (now shown). A wireless mouse 20, as shown in FIG. 2, transmits an optical signal using a signal generator 22 located at an end of a mouse body 21 to a signal receiver (now shown) connected to the computer.

Recently, the PC-TV having functions of a television and a computer has been introduced. The functions of the PC-TV are controlled, using a remote controller integrated with a wireless mouse as shown in FIG. 3. The remote controller integrated with a wireless mouse is obtained by combining a remote controller for controlling a television and a wireless mouse for controlling a computer. In the remote controller integrated with a wireless mouse, a multitude of buttons 32 and a track ball 34 are encased in a body 30 for operating functions. The track ball 34 is capable of freely rolling, such that the position of a cursor can move on the screen of the PC-TV. Optical Function control signals are transmitted to the PC-TV through a signal generator 36 on an end of the body 30 by the operation of the buttons 32 and the track ball 34.

However, there are many inconveniences in the use of a conventional remote controller integrated with a wireless mouse. First, if the integrated remote controller/wireless mouse is used on a desktop or an a mouse pad, as a typical mouse is used, it may not be possible to control the television functions because the integrated remote controller/wireless mouse must be pointed toward the PC-TV. On the other hand, if the integrated remote controller/wireless mouse is used like a typical remote controller, it is difficult to use the integrated remote controller/wireless mouse as a pointing device because the track ball must be operated by the fingers. Also, because of the proximity of the buttons for controlling the television and the mouse buttons, unintentional operations sometimes occur.

SUMMARY OF THE INVENTION

It is an objective of the present invention to provide a remote controller integrated with a wireless mouse in which PC operating buttons and television operating buttons are operated independently to reduce inadvertent operations of the buttons, and at the same time employing a ball for functioning as a conventional mouse for a PC.

Accordingly, to achieve the above objective, a remote controller integrated with a wireless mouse according to the present invention includes first and second buttons installed on the upper surface of a body for operating first and second apparatuses, respectively; a signal generator for generating optical signals for controlling functions of the apparatuses in accordance with the operation of the buttons; and a track ball, protruding from the bottom surface of the body, to allow free rolling movement for operating the second apparatus.

According to another embodiment of the present invention, there is provided a remote controller which further comprises a cover member capable of opening and closing the top surface of the body, covering the top surface of the body such that the first buttons are covered and the second buttons are exposed.

Preferably, the cover member has one end hinge-coupled to the body which is capable of pivot-movement, to thereby open or close the top surface of the body.

It is also preferable that the remote controller further comprises: a shaft extending from the body; a rotating connection member rotatably connected to the shaft; and pivot pins formed on both sides of the rotation connection member, connected to the one end of the cover member, wherein when the rotating connection member is rotated 180°, the inner surface of the cover member faces the bottom surface of the body.

Preferably, the cover member includes a hole through which the second buttons pass to be exposed.

According to still another embodiment of the present invention, there is provided a remote controller which further comprises: a cover member installed on the body to cover the first and the second buttons; and an elastic push piece formed on the cover member to interlock with the second buttons when the top surface of the body is covered.

Preferably, the cover member rotates, hinge-connected to the front end and the rear end of the body.

It is also preferable that a locking protrusion is formed on the cover member, and a locking groove connected to the locking protrusion is formed on the side of the body, to lock the cover member.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENTS

Referring to FIGS. 4A through 4D, a multitude of buttons 110 for operating functions are installed in a body 100 of an integrated remote controller/wireless mouse according to the present invention. The buttons 110 include television operating buttons 111 and mouse buttons 112.

Figure 4A:
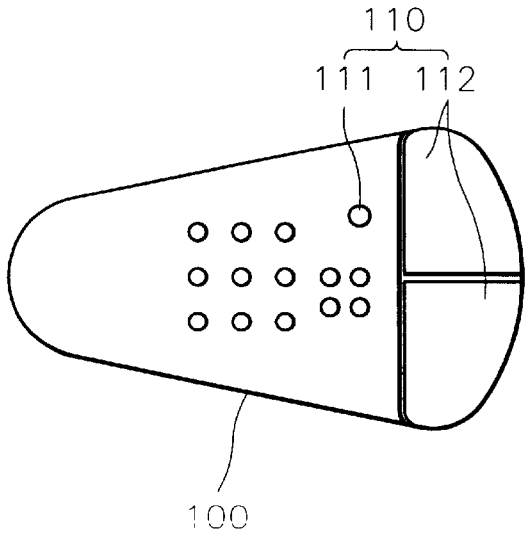
FIGS. 4A through 4D are schematic views of an integrated remote controller/wireless mouse according to one embodiment of the present invention.
Figure 4B:
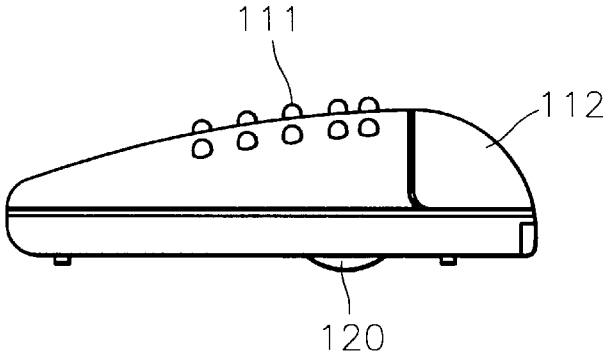
Figure 4C:
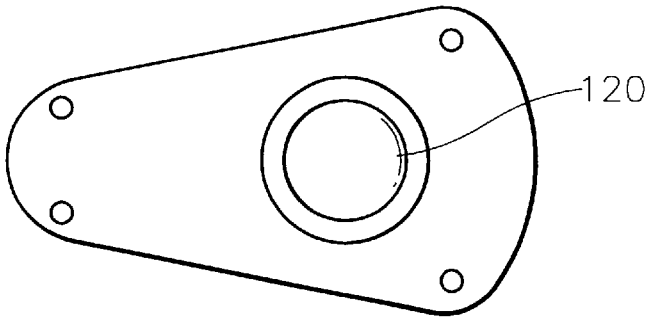
Figure 4D:
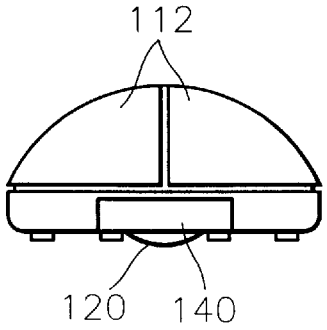

Referring to FIG. 4D, a signal generator 140 for generating optical signals in accordance with the operation of the buttons 110 is installed at an end of the body 100. A ball 120 capable of freely rolling is installed on the bottom portion of the body 100.

The operation of the integrated remote controller/wireless mouse having the above structure will be described. In the case of controlling functions of the television (not shown), as in the case of using a typical remote controller (not shown), the television operating buttons 111 are operated, to thereby generate optical signals through the signal generator 140 for controlling functions of the television. The optical signals are received in a receiver (not shown) on the television, and the functions of the television, e.g., on/off, channel, and volume, can be controlled.

Figure 1:
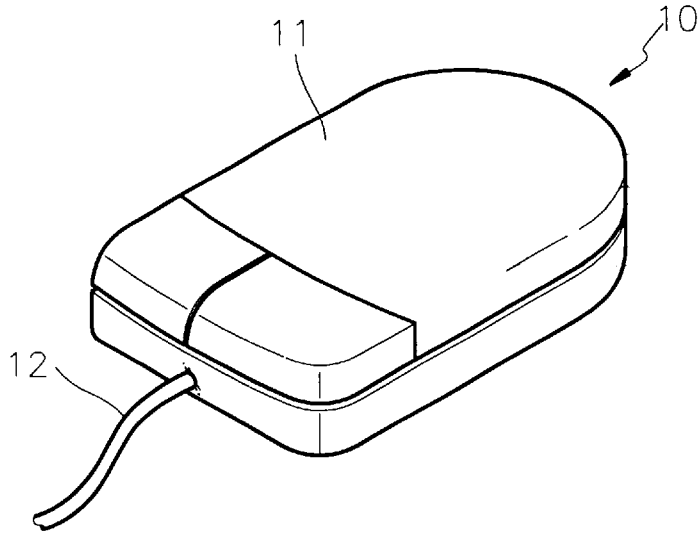
FIG. 1 (PRIOR ART)
FIG. 1 is a schematic perspective view of a wired mouse of a typical computer.
Figure 2:
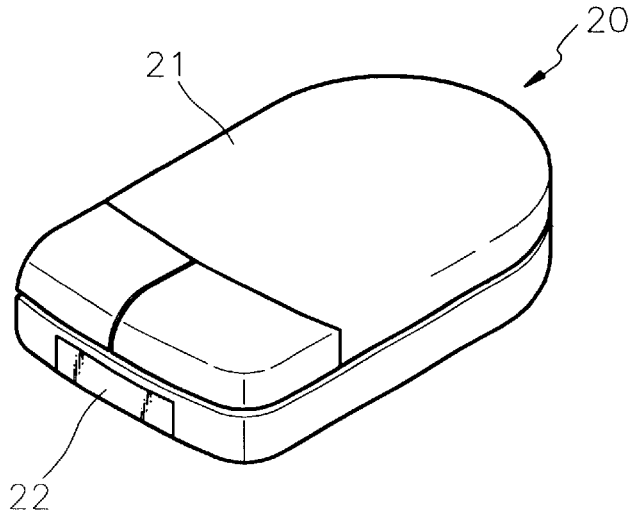
FIG. 2 (PRIOR ART)
FIG. 2 is a schematic perspective view of a wireless mouse of a typical computer.
Figure 3:
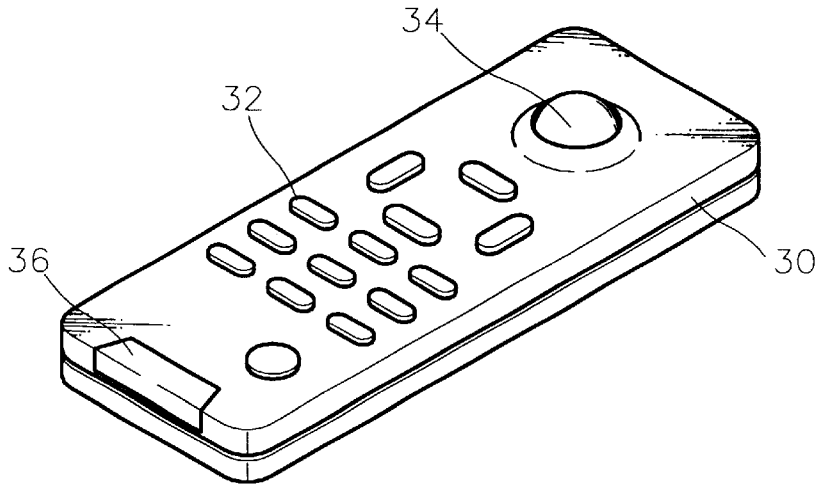
FIG. 3 (PRIOR ART)
FIG. 3 is a schematic perspective view of a conventional integrated remote controller/wireless mouse.

Meanwhile, in order to control the PC, the mouse buttons 112 are operated. For example, in order to move the position of the cursor on a monitor of the PC, the integrated remote controller/wireless mouse can be moved, in the state in which the body 100 is placed on a desk top or a mouse pad, as with a typical mouse (see FIGS. 1 and 2). Thus, the ball 120 on the bottom of the body 100 can roll by contact with the desk top or mouse pad, to thereby move the cursor to a desired position on the monitor. After moving the cursor, the mouse buttons 112 can be pressed to thereby generate optical signals. The optical signals are received in a receiver (not shown) of the PC.

Figure 5A:
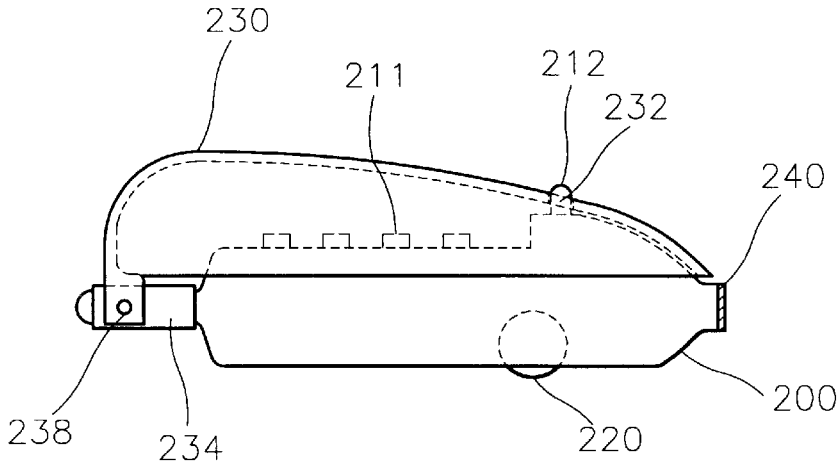
FIGS. 5A through 5D are schematic views of an integrated remote controller/wireless mouse according to another embodiment of the present invention.

Referring to FIG. 5A, the integrated remote controller/wireless mouse according to another embodiment of the present invention includes a multitude of television operating buttons 211 and mouse buttons 212 on a body 200, a ball 220 capable of freely being rotated, on the bottom portion of the body 200, a signal generator 240 for generating optical signals, and a cover member 230 covering the upper portion of the body 200.

The cover member 230 covers the body 200 such that the television operating buttons 211 are covered and the mouse buttons 212 are exposed, which is for preventing operation of the television operating buttons 211 during operation of the mouse buttons 212. The mouse buttons 212 protrude from a hole 232 formed on the cover member 230 as shown in FIG. 5A.

The cover member 230 is connected to the body 200 by a pivot pin 238 and a rotating connection member 234 to allow pivotal and rotational movement. That is, the cover member 230 can move pivotally around the pivot pin 238, and rotate around the rotation connection member 234.

Figure 6:
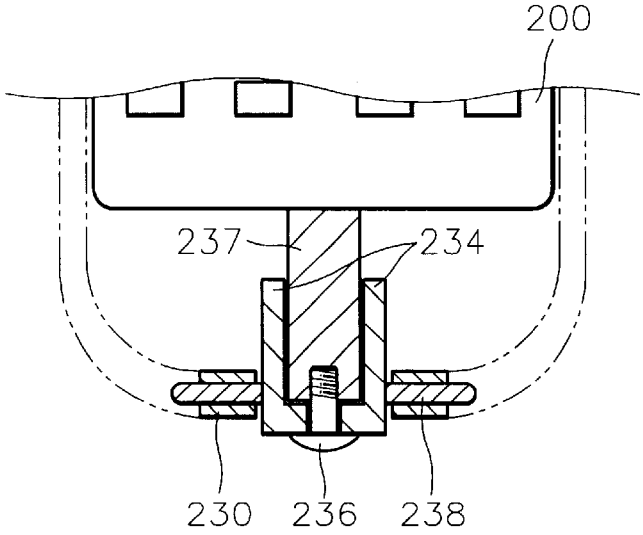
FIG. 6 is a sectional view, showing a portion of the remote controller shown in FIG. 5A.
Figure 7:
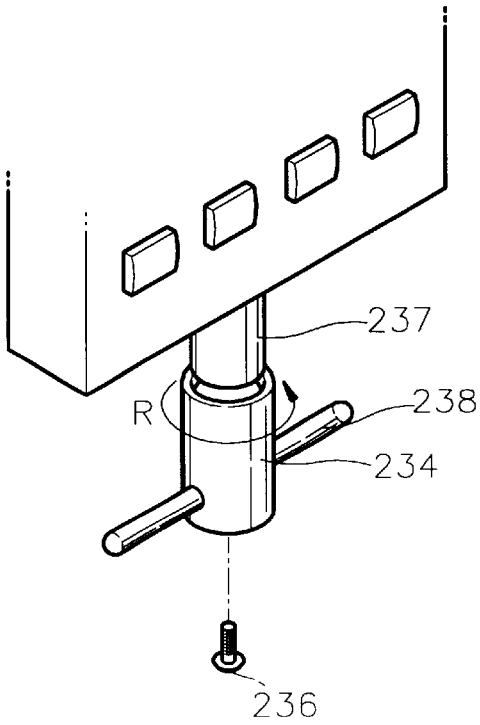
FIG. 7 is a perspective view, showing a portion of the remote controller shown in FIG. 5A.

In detail, as shown in FIGS. 6 and 7, the rotating connection member 234 is connected to a shaft 237 extending from the body 200 by a screw 236 to rotate in the direction R. The pivot pins 238 protrude symmetrically from both sides of the rotating connection member 234, and the end of the cover member 230 is hingecoupled to the pivot pin 238.

The operation of the remote controller integrated with a wireless mouse according to the embodiment of the present invention will now be described. In order to control a PC (not shown), as shown in FIG. 5A, the mouse buttons 212 protruding from the passing hole 232 are operated in the state in which the upper portion of the body 100 is covered on the cover member 230.

The cover member 230 covers the television operating buttons 211 to prevent unintended operation of the television. Also, movement of the mouse, which can be located on a desk top or on a mouse pad, causes rotation of the track ball 220 under the body 200, to thereby control the PC.

Figure 5B:
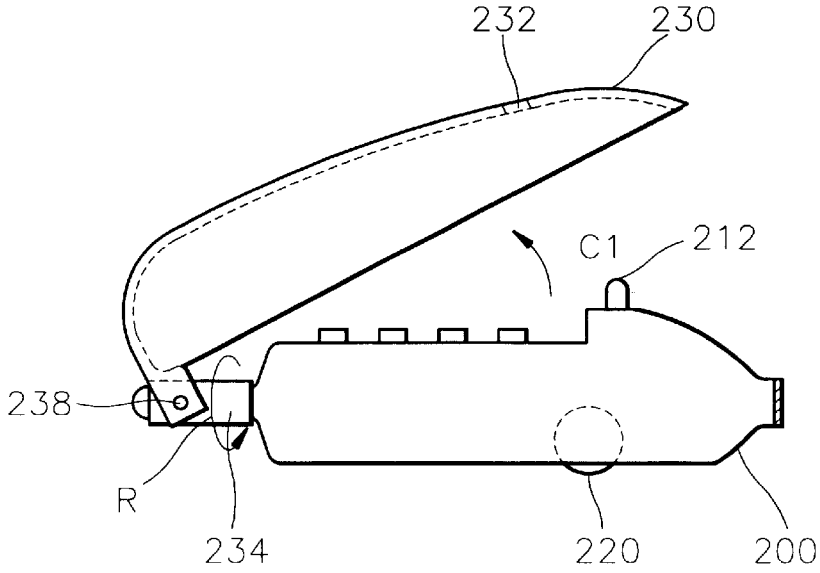
Figure 5C:
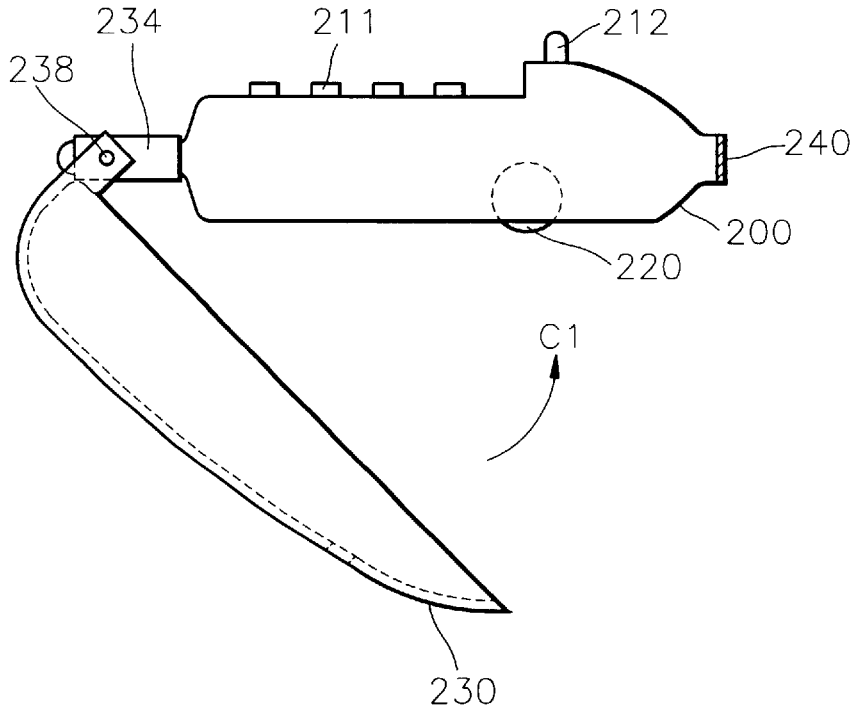

Meanwhile, in order to control a function of the television, as shown in FIG. 5B, the cover member 230 is rotated counterclockwise, in the direction of C1, around the pivot pin 238, to thereby open the upper portion of the body 200. Subsequently, as shown in FIG. 5B, the cover member 230 is rotated 180° in the direction of R, around the rotation connection member 234. Thus, as shown in FIG. 5C, the positions between an inner surface of the cover member 230 and an outer surface thereof are exchanged, so that the inner surface of the cover member 230 faces the bottom of the body 200.

Figure 5D:
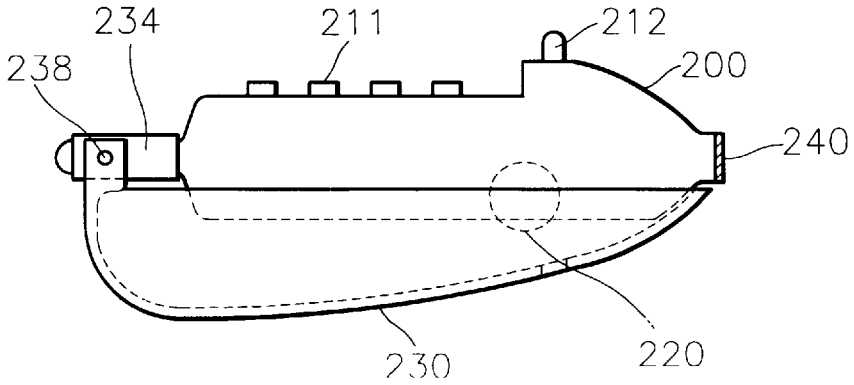

Here, when the cover member 230 is rotated counterclockwise, i.e., in the direction of C1 around the pivot pin 238, as shown in FIG. 5D, the cover member 230 covers the bottom of the body 200 including the ball 220. Thus, the television can be controlled by operating the television operating button 211. At this time, the cover member 230 covers the ball 220, so that the ball 220 does not contact any surface, to thereby prevent unintended operation of the mouse.

Figure 8A:
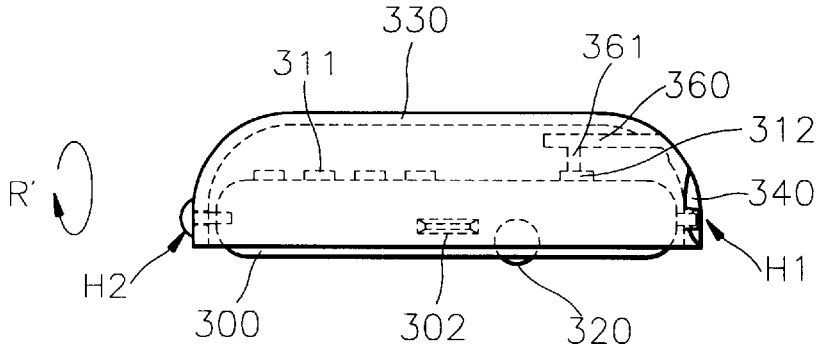
FIGS. 8A and 8B are side and plan views, respectively, showing an integrated remote controller/wireless mouse according to still another embodiment of the present invention.
Figure 8B:
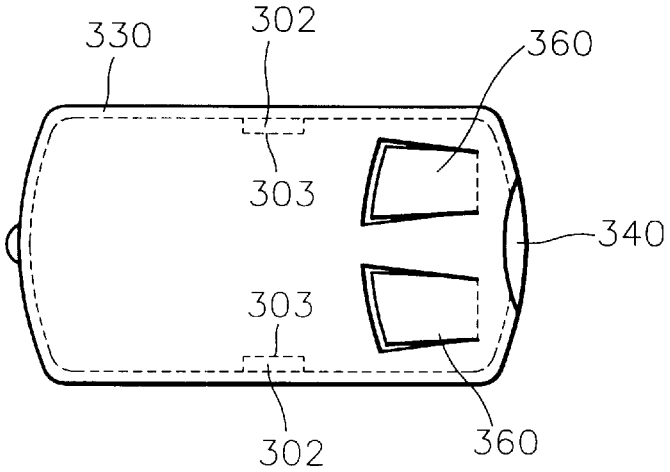

Referring to FIGS. 8A and 8B showing still another embodiment of the present invention, a cover member 330 is rotatably hinge-coupled at hinge points H1 and H2 of the front and back ends of the body 300.

A locking groove 303 connected to a locking protrusion 302 of the cover member 330 to temporarily lock the cover member 330 is formed in the body 300.

Also, elastic push pieces 360 are formed on the cover member 330, and the push pieces 360 can be formed, for example, by partially cutting out the cover member 330. Extension members 361 contacting the mouse buttons 312 are formed in a single body at the bottom surface of the push pieces 360.

In the operation of the above-described integrated remote controller/wireless mouse according to the present invention, when the cover member 330 covers the upper surface of the body 300 and the locking protrusion 302 is connected to the locking groove 303 as shown in FIG. 8A, extensions 361 of the push pieces 360 contact the mouse buttons 312. Thus, the mouse buttons 312 are operated by pressing the push pieces 360, and the cursor position is moved by rotating the track ball 320 protruding from the bottom of the body 300.

Meanwhile, in order to control the television, the cover member 330 is rotated in the direction R' around hinge points H1 and H2. The rotated cover member 330 covers the bottom surface of the body 300 where the track ball 320 protrudes. In this state, the locking protrusion 302 is connected to the locking groove 303 to lock the cover member 330. Thus, the television operating buttons 311 installed on the body 300 are operated, to thereby control the television. Reference numeral 340 denotes a signal generator generating optical signals.

According to the remote controller integrated with a wireless mouse of the present invention, the ball mounted on the bottom surface of the body can function like the ball of a conventional mouse, and the mouse buttons and the television operating buttons can be independently operated depending on the position of the cover member, to thereby suppress unintended operation of the apparatus.

It should be understood that the invention is not limited to the illustrated embodiment and that many changes and modifications can be made within the scope of the invention by a person skilled in the art.

What is claimed is:

1. A remote controller comprising:

at least one first button and at least one second button installed on an upper surface of a body for operating first and second apparatuses, respectively;

a signal generator for generating optical signals for controlling respective functions of the first and second apparatuses in accordance with the operation of said at least one first button and said at least one second button, respectively;

a track ball, separate from said at least one first button and said at least one second button, protruding from a bottom surface of the body, for operating the second apparatus, wherein said track ball faces in an opposite direction from a direction that said at least one first button and said at least one second button face; and a cover member for selectively opening and closing a top portion of the body, wherein when the top surface portion of the body is closed, said at least one first button is covered, and said at least one second button is exposed, wherein the cover member has a hinge coupled to one end of the body, which is capable of pivot-movement, to thereby open or close the top portion of the body, and wherein the remote controller further comprises:

a shaft extending from the body;

a rotating connection member rotatably connected to the shaft; and pivot pins formed on both sides of the rotation connection member, connected to one end of the cover member, wherein when the rotating connection member is rotated 180°, the inner surface of the cover member faces a bottom surface of the body.

2. A remote controller comprising:

at least one first button and at least one second button installed on an upper surface of a body for operating first and second apparatuses, respectively;

a signal generator for generating optical signals for controlling respective functions of the first and second apparatuses in accordance with the operation of said at least one first button and said at least one second button, respectively;

a track ball, separate from said at least one first button and said at least one second button, protruding from a bottom surface of the body, for operating the second apparatus, wherein said track ball faces in an opposite direction from a direction that said at least one first button and said at least one second button face;

a cover member installed on the body to cover said at least one first button and said at least one second button, thereby preventing depression of said at least one first button; and at least one elastic push piece formed on the cover member for selectively contacting only at least one of said at least one second button when a top portion of the body is covered, wherein the cover member is rotatably connected to opposite ends of the body, and the cover member is operable to selectively expose at least one of said at least one first button and said at least one second button, and the cover member is operable to cover said track ball, upon rotation of the cover member.

* * * * *